United States Patent [19]

Flegel et al.

[11] 4,130,907

[45] Dec. 26, 1978

[54] SQUAT-TYPE WATER CLOSET

[75] Inventors: George J. Flegel, Michigan City; Roger L. Mielbeck, Laporte; Patrick J. Pizarek, Michigan City, all of Ind.

[73] Assignee: Josam Manufacturing Co., Michigan City, Ind.

[21] Appl. No.: 827,065

[22] Filed: Aug. 23, 1977

[51] Int. Cl.[2] ..... E03D 1/00; E03D 3/00; E03D 5/00

[52] U.S. Cl. ..... 4/300; 4/329; 4/420

[58] Field of Search ..... 4/10, 76, 9, 77, 79, 4/89, 90, 91, 102

[56] References Cited

U.S. PATENT DOCUMENTS

| | | | |
|---|---|---|---|
| 1,132,374 | 3/1915 | Moore | 4/10 |
| 2,486,736 | 11/1949 | Dodson | 4/10 |
| 3,908,202 | 9/1975 | Sargent et al. | 4/10 |
| 4,012,797 | 3/1977 | Kristoffersen | 4/10 |

*Primary Examiner*—Henry K. Artis
*Attorney, Agent, or Firm*—Isler & Ornstein

[57] ABSTRACT

A squat-type water closet self-supporting in environment of installation, especially in a poured or pre-cast slab-type floor, without need of boxing, is provided by a bowl casting having a horizontal cast flange for anchored support on a rough slab or other environmental structure, and a flush rim casting gasketed to a seat on and defining with the bowl top margin a flushing water passage and peripheral bowl-flushing slot; the rim opening being level with floor and defining the visible closet opening; a vitreous coat and/or full porcelain enamel being applied to wetted and visible surfaces; the two members being shaped for casting without coring; and flashing-securing means being optional.

12 Claims, 3 Drawing Figures

SQUAT-TYPE WATER CLOSET

The present invention is concerned with a so-called squat-type water closet which, as contrasted with a conventional floor-supported or wall hung seat type, rather is installed in a floor substantially level with the floor surface, so that a person may squat over and straddle the opening in using the closet.

Hitherto squat water closets, whether fabricated as vitrified china, or porcelainized cast-iron, or drawn corrosion resistant or stainless metal, have entailed various disadvantages in fabrication, installation and/or use. Molding and/or coring or tooling requirements are quite costly in equipment costs, material and labor. Prior closets of this type have had to be boxed in with a formed sheet steel supporting and enclosing structure, usually stainless, which is anchored to, and engages the environment, and itself in turn directly supports the closet, and which usually affords as well a sealing and decorative concealing dress. This ancillary structure required for an acceptable installation is also rather costly in manufacture and installation.

In other water closets of the seat type, represented by Torrance U.S. Pat. No. 906,470, granted Dec. 8, 1908, attempts have been made to reduce cost by fabrication in two primary pieces; namely, a bowl and a rim cooperating with the upper region of the bowl to provide flushing water passages. On the other hand, some drains of flushing rim and non-flushing types have been made in two parts with bowl flanged for support on the environment.

By the present invention there is provided a squat-type water closet, self-supporting especially in a prepoured or cast concrete slab type floor, and effectively sealable against floor and other leakage; thus advantageously eliminating need to be boxed-in for installation. For this, a basically two-piece structure is used comprising a flush rim casting and a simple bowl member casting preferably both appropriately porcelainized. The bowled or receptacle portion of the bowl member may have a simple bottom outlet with any conventional external form for a soil pipe joint, and the receptacle shape is on the whole conventional. However, in the preferred embodiment later described in detail, the outlet placement aids bowl cleanliness and flushing in the manner later noted. The rim opening, of course, defines the visible water closet opening in the floor.

The bowl includes a peripheral outward flange to bear on the surrounding margins of a closet-accepting hole in the rough floor, with an underlying pad of grouting as needed. On the flange top, blind tapped bosses receive securing bolts for a closed or a two-part non-circular flashing clamp ring. On the flange top there also is a sloped peripheral seat with associated blind-tapped bosses to receive a complimentary bottom seat (with interposed seal means) of the flush rim casting, bolted through appropriate lugs to the latter bosses. These bosses are all on the upward side of the flange enabling the flange to be closer to, indeed, on the rough slab top surface. The bottom of the support flange is upwardly recessed adjacent the depending bowl portion thereby affording an excess grout receiving space, also aiding grout interlock if desired, resulting from rising of grout from the underlying "pad" at the flange outer edge and the recess.

The rim includes an inverted channel-shaped cross section, which requires no extended coring, and in preferred form, serves when seated on and sealed to the bowl flange to form therewith a continuous flush water passage from a supply connection formation at which is connected a valve controlled (e.g., timed flush valve controlled) flushing water supply. The rim defines, by an internal rim wall depending within the bowl opening, a continuous flush slot; the resistance or flow restriction of which decreases from the inlet at the back end to front to ensure water reaching the entire bowl periphery. This, conjoined with a restricting inlet orifice at the supply connection, holds flow down to an effective yet water-conserving minimum at intended operating pressures. Flow is directed bilaterally in the passage by an interior V-shaped vertical flow diverter and divider baffle located on the far wall of the channel and having its edge aligned with the orifice centerline.

The general object of the present invention is to provide an improved squat-type water closet. Another object is to provide a squat-type water closet of flanged porcelainized cast iron construction which is adapted to self-support, especially in a poured or pre-cast slab floor, without need to be boxed-in.

Another object is to provide a water closet of the character described comprising, as primary elements, an appropriately porcelainized bowl member and a flushing rim member to define flushing passages, which afford controlled flush flow for effective flushing with minimum water consumption.

A further object is to provide an acceptable squat-type water closet of relatively low cost for fabrication and installation.

Other objects and advantages will appear from the following description and drawings, wherein.

GENERAL STRUCTURE

Figure 1:
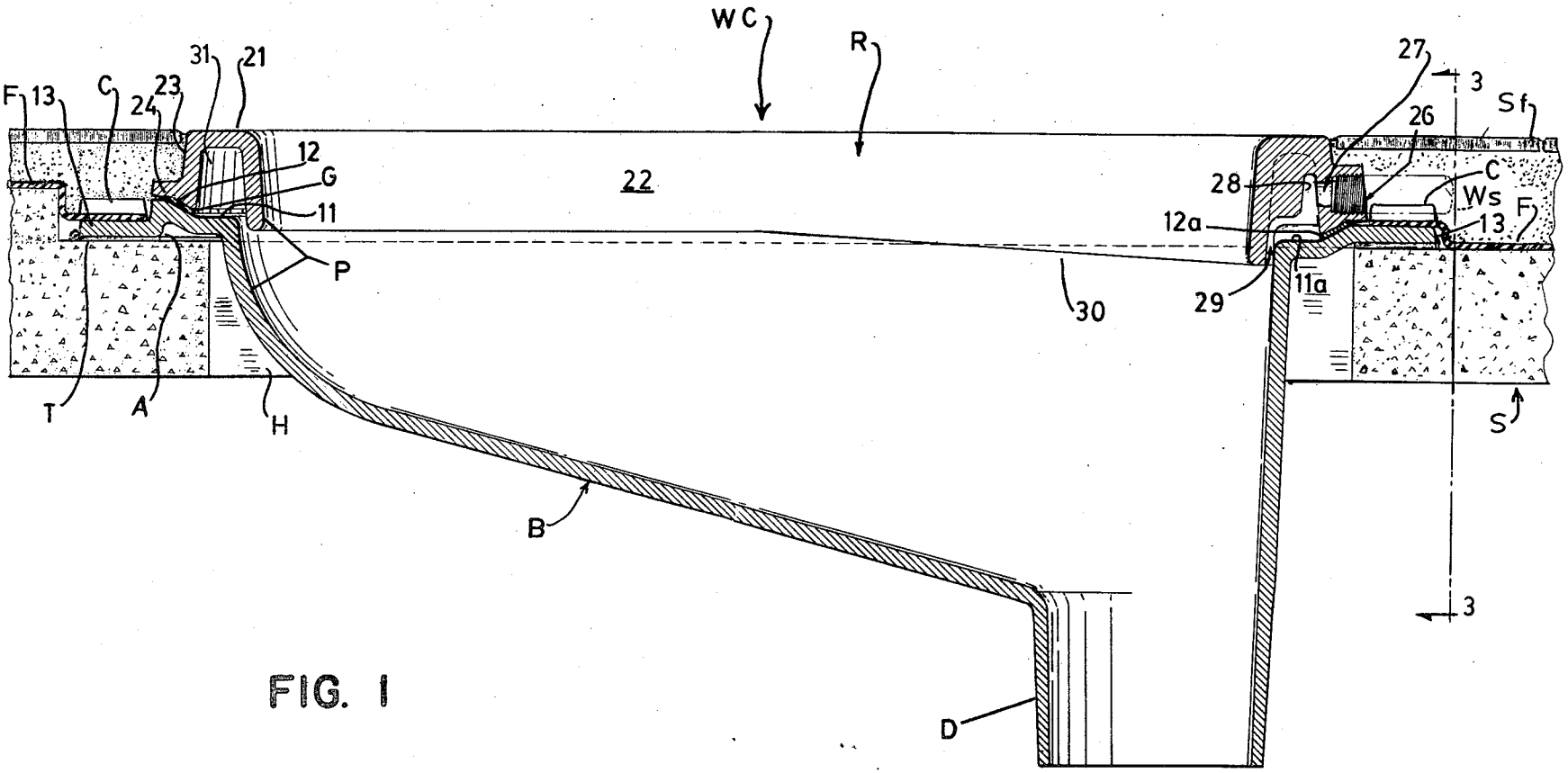
FIG. 1 is a longitudinal section, through a water closet and adjacent environment of installation.
Figure 2:
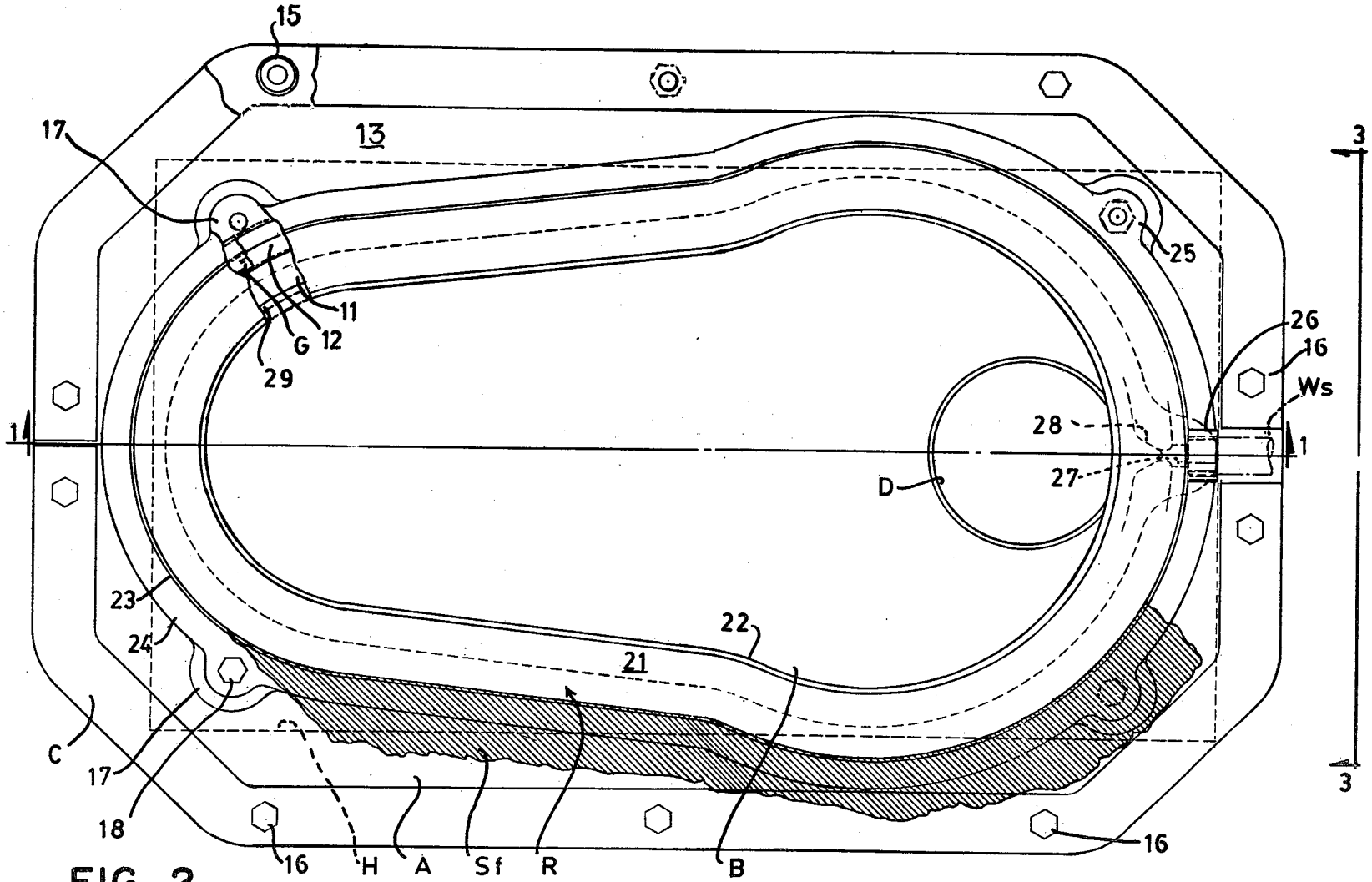
FIG. 2 is a top plan view of the water closet, corresponding to FIG. 1, but with substantially all enclosing environmental structure broken away.
Figure 3:
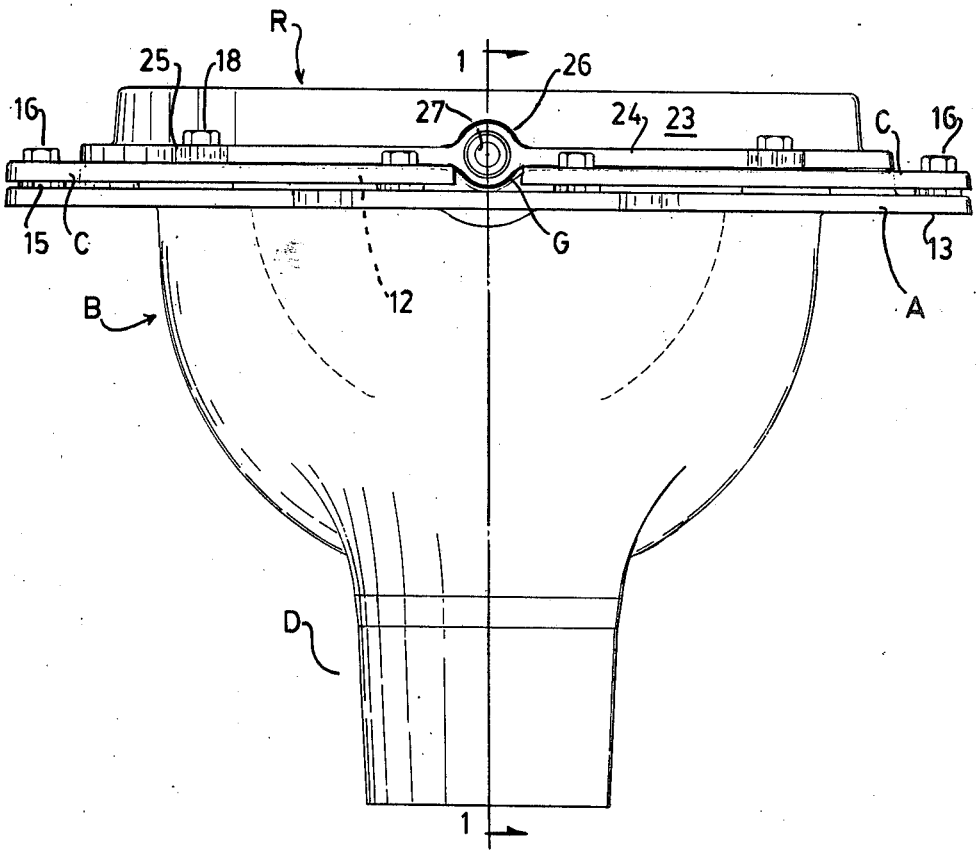
FIG. 3 is an outline and elevation of the back end of the water closet.

The embodiment WC of the squat-type water closet invention is shown in the drawings as installed at hole H in a concrete floor rough slab S, over which after closet installation there is poured or otherwise emplaced the finish structure Sf, establishing the floor finish level, e.g., a smooth troweled fine concrete or grout layer, or tile or other surface-providing treatment of known conventional form. Conventionally waterproofing sealing flashing sheet F may be laid before the floor finish structure.

The water closet, preferably to be supplied to the job site as a unit, is comprised of a bowl member B and a non-splash flush rim member R, the rim member being secured to and by seal means G sealed to the bowl member top region.

The bowl discharge or outlet includes a short projecting formation D adapted to be connected to a sanitary soil line fitting, usually a trap, in conventional manner, as by the arrangement known in United States of America and many other countries, through a trademark designation, as a "No-Hub" connection.

For feeding flush water into a peripherally continuous flush water passageway 31 defined at least in part by the flush rim member, at one end of the water closet, there is provided the connection for an appropriately valved, e.g., metering flush-valved, water supply line Ws; here a threaded connection 26 at the back of the flush rim as later described.

The bowl and rim members preferably are grey iron castings, protected over the entire water-exposed inside surface of the bowl and over the visible and wetted portions of the rim, at least to the extent of a protective vitrified ground coat, and further preferably with a full vitreous enamel finish P at the as-installed visible flat top and inner keyhole-shaped closet-opening-defining inner exposed periphery of the rim member, and on the bowl inside surface for a part of the way down from the rim.

Apart from bolts and sealing means, and optional flashing clamping means, the preferred unit thus is basically a two-piece structure, since all other structural features required are integrally cast into one or the other of the main casting members B or R as further described.

BOWL MEMBER

The bowl member B, in a rather conventional shape with keyhole-shaped bowl top opening, has the sides curving down and into the bottom and the bottom sloping from front to the outlet D at the very back (so denominated from customary body orientation of a user). Advantageously the extreme back wall region drops straight down into the tubular portion of outlet D; and the outlet opening is so located that semi-solid excreta often in great part will drop directly through the outlet opening, and any splatter on the back wall regions will be on vertical or near vertical surfaces for more ready flushing.

The lower back portion of the bowl is about a half a hemisphere in approximate shape with the outlet occupying nearly a quadrant thereof, which further conduces to an effective flushing pattern, forward of the outlet.

However, the integrally-cast, generally horizontal outward anchor and support flange A, of cropped-corner rectangular plan outline, over most of the periphery (as seen at lest in FIG. 1), from the bowl top opening, runs out flat at 11 to the beginning of a peripherally continuous seat formation 12, having an inner slope surface rising to a flat top or land and then dropping to a flat horizontal marginal part 13 extending out to the flange edge. At the back center, the portion 11 and the seat 12 are arcuately depressed at **11*a*, 12*a*, to accommodate a water connection fromation on rim R later described. Clearance for depressed bottom flange portions below 11*a*, 12*a***, is provided by the usual hole size of H.

Thus bowl B has about its upper periphery a generally horizontal and continuous outward integral anchor and support flange A, with a flat outer margin 13 whereby it is supported on the surrounding rough poured slab, with underlying grouting pad T for leveling as needed. In addition to the grouting interlock usually afforded (not shown) by excess grouting rising around its outer edge and upward into a bottom recess below 11–12, the unit may be further anchored at the slab, if desired, by anchor bolts in the concrete extending through apertures (not shown) in 13, or by slab-engaging clamps received in bottom formations adjacent bowl sidewalls of the flange.

Above the top surface and at extreme margins of flange A project cast bosses 15 with downward blind holes tapped to receive bolts 16 for flashing clamp device C; while similar bosses 17 are located just on the outside of seat 12 to receive respective rim clamp bolts 18. The upward bosses, without tapped hole penetration, allow the flanged structure A to be brought deeper in the floor, closer to the top of the basic rough-poured or pre-cast slab.

The flashing clamping device here is an interrupted, or two-piece "ring" C comprised of two like cast half-ring or broad U-shaped pieces, with apertures therethrough for the clamp bolts 17.

FLUSHING RIM MEMBER

The rim member casting R has an inverted trapezoidal trough-shaped section, of which the flat top wall 21 and inner side wall 22 provide first the as-installed visible parts of the rim, defining the effective top opening of the closet at floor level; while the outer shorter side wall 23 terminates in a continuous bottom flange seat 24 mating the bowl seat 12 by a sloping inner and a flat outer bottom portion. On the flange 24 external ears or lugs 25 are apertured for the rim securing bolts 18. The continuous seal means G interposed between the seats of bowl and rim may be a continuous strip gasket or a continuous permanently elastic coating.

Thus the rim channel, with the flat 11 and slope of seat 12 of the flange, defines a continuous flush water passage 31 in a circuit continuous about the entire bowl top margin, and with inlet at the threaded water connection formation 26. The passageway 31 discharges each flush of water down the bowl side walls as a substantially peripherally continuous sheet of flushing flow through a slot in turn defined between the top inner edge of the bowl side wall and the rim depending inner wall bottom lip or edge.

There is also provided an anti-splash expedient, or perhaps more accurately, an expedient for abating spray arising especially in the region of the water inlet at the back, by some water clinging to and sweeping around under and partially up the depending lip and leaving it as a spray. For this purpose surprisingly, it is sufficient to terminate the inside or slot-forming surface of wall 22 at a substantially angular or rather sharp corner, i.e., small radiused corner, provided over the rim back arc for say about 45° to each side of the inlet center line, 90° total. The bottom corner toward the bowl interior may be quite rounded.

The connection from water piping Ws communicates with the passageway 31 through an inlet orifice 27 axially aligned with the apical vertical edge of a somewhat V-section divider or diverter baffle 28, the diverging sides of which curve to merge with the far inside surface of wall 22 to direct water bilaterally down the passageway 31. Locally the seat portion on the outer wall bottom edge drops down curving under connection formation 26 as accommodated by the bowl seat.

Importantly, the flush slot 29 represents a restriction, which provides a flow resistance high near the inlet, but decreasing toward the front end, by a widening of the gap between flange inner wall 22 and bowl edge (from one end to the other) and also by a decrease in the extent of the skirt-like portion 30 depending within the bowl top from the back to center of the enlargement of the closet top opening.

The connection formation 26 is easily produced as a cast hollow boss subsequently threaded and drilled through to produce orifice 27 of selected size.

The outside wall surface of the rim provides in effect a ground up to which surface finish tiling or smooth-trowelled concrete is brought flush with the rim top surface in completing the flooring.

It is seen that in this preferred form, a closet is provided which is itself supported and anchorable in the environment, without need of an ancillary sheet metal structure or the like to box it in and support it. Further, a simple two-piece cast metal structure is afforded, each piece of which is producible with relatively simple patterns and particularly without expensive coring to provide flush water flow passages.

What is claimed is:

1. A squat-type water closet for installation in and substantially level with a floor and providing at the floor surface an elongated opening, comprising: a bowl member having a waste outlet or discharge opening from the bowl bottom and having a discharge connection formation for connecting to a soil line, a bottom sloping downwardly inwardly and from front to back to the outlet, outwardly extending horizontal flange means for bowl-supportive engagement with environmental structure, and an integral flange having on its top region an upraised peripherally continuous seat formation, a flushing rim member having its outer periphery complementarily shaped and sloped to be matingly received within said seat formation continuous with a seal interposed between said rim member and seat formation to define the effective top opening of the water closet, and said flushing rim member being downwardly open and cooperating with the bowl member top region to form a flush water passageway and defining with the top margin of the bowl opening a slot substantially continuous about the bowl top periphery to discharge water in a substantially peripherally continuous sheet down the bowl inside surface for flushing the bowl interior, a flushing water supply connection integrally formed on one of said members providing an inlet to said flush water distribution passageway, said flushing water supply connection communicating with said flush water passage through an inlet-restricting orifice at one end of the closet whereby to increase the velocity of said flush water in said passage, one of said members supporting a V-shaped divider baffle with vertical apical edge aligned with the orifice axis for dividing incoming flushing water to flow bilaterally down the passageway along each side of the water closet, and means for securing said flushing rim member sealed to the seat formation on the bowl.

2. A squat-type water closet as described in claim 1, wherein said slot, to insure flushing water distribution, constitutes a discharge flow restriction symmetrically decreasing from the inlet orifice toward the remote end of the bowl.

3. A squat-type water closet as described in claim 1 especially adapted for installation in a poured concrete slab floor having a closet-receiving opening, wherein said members are rigid metal castings, and said flange means includes a continuous seal seat formed integrally to its top side to provide said seat surface.

4. The water closet of claim 3, wherein said bowl member is cast with its said seat spaced out from and sloping toward the bowl top opening, and said rim member being secured on the top of the bowl by bolts located externally of the seats.

5. The water closet of claim 3, wherein the rim member as an integrally-cast structure includes a downwardly-open channel running continuously around the peripheral rim circuit to define with said bowl flange the flush water passage, said supply connection comprising a threaded opening at the rim back end communicating with said flush water passage, and said water outlet being at the rearmost portion of said bowl bottom and defining the lowermost portion thereof.

6. A squat-type water closet as described in claim 3, wherein said rim member includes a flat visible top surface, and outlines a smoothly rounded keyhole-shaped opening into the water closet bowl, the rim member including apertured outward lugs for securement to the bowl flange by bolt means located below said flat top surface, so that a floor finish structure may be carried level up to the visible top surface of the rim.

7. The water closet of claim 3, with the means securing the rim member to the bowl member comprising an interposed continuous annular sealing gasket, and securing bolts through rim outer lugs into tapped holes in the bowl flange.

8. The water closet of claim 3, wherein said supply connection is at the back region of the water closet and located for connection to a flushing water supply line below floor finish surface level.

9. The water closet of claim 3, wherein the said flange provides an upper surface portion integral with said bowl adapted to receive thereon flashing incorporated in the floor and carried up toward the slab opening;

said water closet being provided with means for clamping the flashing margin on the flange;

the last said means being disposed entirely below the level of the rim member top to be concealed by the floor finish structure carried in to the rim member upper margin.

10. The water closet of claim 9, wherein the clamping means comprises clamp plate means and bolts through the clamp plate means threaded into integral tapped bosses on the flange.

11. The water closet of claim 5, wherein said rim casting has a rim channel inside wall extension or depending skirt on its inner perimeter to define, relative to the bowl top inside edge, a flush discharge slot increasing in width and decreasing in extension thereby decreasing in flow restricting resistance from the inlet toward the opposite water closet end.

12. A water closet as described in claim 11, wherein the flush discharge slot-defining surface of the rim wall, to either side of the inlet location, terminates downwardly in a substantially angular corner to abate spray from the slot.

* * * * *